US008251364B2

(12) United States Patent
Morinaga et al.

(10) Patent No.: US 8,251,364 B2
(45) Date of Patent: Aug. 28, 2012

(54) SHEET FEEDING APPARATUS

(75) Inventors: Kazuyuki Morinaga, Machida (JP); Kenji Kawazoe, Yokohama (JP); Masaya Shimmachi, Kawasaki (JP); Tetsu Hamano, Tokyo (JP); Toshiaki Tokisawa, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/961,824

(22) Filed: Dec. 7, 2010

(65) Prior Publication Data

US 2011/0140353 A1 Jun. 16, 2011

(30) Foreign Application Priority Data

Dec. 14, 2009 (JP) ..... 2009-282696

(51) Int. Cl.
*B65H 1/26* (2006.01)
*B65H 1/10* (2006.01)

(52) U.S. Cl. ..... 271/157; 271/160

(58) Field of Classification Search ..... 271/147, 271/157–160, 126, 127
See application file for complete search history.

(56) References Cited

U.S. PATENT DOCUMENTS

| | | | | |
|---|---|---|---|---|
| 5,240,241 | A | 8/1993 | Kawazoe | |
| 5,253,854 | A * | 10/1993 | Tanoue et al. | 271/10.12 |
| 5,398,108 | A | 3/1995 | Morinaga et al. | |
| 5,443,252 | A | 8/1995 | Morinaga et al. | |
| 5,564,690 | A * | 10/1996 | Oshida | 271/157 |
| 5,571,265 | A | 11/1996 | Yagi et al. | |
| 5,722,654 | A | 3/1998 | Sootome et al. | |
| 5,886,729 | A | 3/1999 | Hiramatsu et al. | |
| 6,113,093 | A | 9/2000 | Morinaga et al. | |
| 6,783,126 | B2 * | 8/2004 | Amamoto | 271/152 |
| 7,240,899 | B2 * | 7/2007 | Amamoto | 271/126 |
| 7,648,134 | B2 * | 1/2010 | Lim | 271/118 |
| 8,016,283 | B2 * | 9/2011 | Ueda et al. | 271/117 |
| 2003/0116906 | A1 * | 6/2003 | Amamoto | 271/126 |
| 2006/0157914 | A1 * | 7/2006 | Suwa | 271/126 |
| 2007/0001376 | A1 * | 1/2007 | Lim et al. | 271/121 |
| 2009/0140489 | A1 * | 6/2009 | Takeuchi et al. | 271/109 |
| 2011/0133397 | A1 * | 6/2011 | Shimmachi et al. | 271/265.01 |

FOREIGN PATENT DOCUMENTS

| | | |
|---|---|---|
| JP | 03-079537 | 4/1991 |
| JP | 08-259039 | 10/1996 |
| JP | 2006-137564 | 6/2006 |

* cited by examiner

*Primary Examiner* — Kaitlin Joerger
*Assistant Examiner* — Patrick Cicchino
(74) *Attorney, Agent, or Firm* — Fitzpatrick, Cella, Harper & Scinto

(57) ABSTRACT

A printer has a separating unit, such as a depressing cam and a depressing slider, which presses a middle plate against the biasing force of a spring and separates a sheet on the middle plate from a sheet feeding roller by a predetermined distance, a separation driving unit, such as a DC motor, which moves the separating unit, a measuring unit which measures the driving load applied to the separation driving unit when the separation driving unit drives the separating unit, and a load imparting unit, such as a brake plate, which imparts load to the middle plate, the separating unit, or the like. The brake plate or the like imparts load when a sheet is separated from the sheet feeding roller by the separating unit, and the brake plate or the like changes the load to be imparted, according to the turning angle of the middle plate.

7 Claims, 16 Drawing Sheets

SHEET FEEDING APPARATUS

BACKGROUND OF THE INVENTION

1. Field of the Invention

The present invention relates to a sheet feeding apparatus which has sheets, such as a plurality of sheets of paper, stacked thereon, and supplies the sheets one by one to a main body of the device.

2. Description of the Related Art

Conventionally, in image forming apparatuses, such as a printer, a copying machine, and a facsimile, which perform separation and feeding for a plurality of stacked sheets and form an image on a sheet, there is a device which detects the amount of stacked sheets as described in Japanese Patent Application Laid-Open No. H03-079537. In this device, a message is issued or processing is changed depending on the amount of stacked sheets detected.

Additionally, in a sheet feeding device which has sheets stacked on a pressure plate, moves the pressure plate up and down during sheet feeding, and makes a feed roller abut the upper surface of a paper, thereby performing feeding, there is a device as described in Japanese Patent Application Laid-Open No. 2006-137564 for the purpose of preventing changes in the operating amount of the pressure plate depending on the stacked amount of sheets.

In the device disclosed in Japanese Patent Application Laid-Open No. 2006-137564, it is possible to keep constant the distance between a sheet upper surface and a feed roller during sheet separation irrespective of an amount of stacked sheets, and keep constant the operating amount of the pressure plate during sheet feeding, thereby keeping the timing of sheet conveyance constant. Also, since it is also possible to minimize the influence of the stacked sheets on alignment caused by the operation of the pressure plate, it is possible to perform stable sheet feeding.

However, when a dedicated switch, a dedicated sensor, and the like are provided for the detection of the amount of stacked sheets as described in Japanese Patent Application Laid-Open No. H03-079537, space and costs will increase mechanistically and electrically.

Additionally, in Japanese Patent Application Laid-Open No. H08-259039, a device which detects the stacked amount of sheets without a dedicated sensor by utilizing an existing sensor for detection of sheet conveyance is proposed.

However, since a change in the operating time of the pressure plate caused by the difference of the stacked amount is detected in Japanese Patent Application Laid-Open No. H03-079537, it is necessary for the operating time of the pressure plate to change according to an amount of stacked sheets.

Meanwhile, in the sheet feeding device in which the operating amount of the pressure plate is kept constant for stability of sheet feeding performance or shortening of time in Japanese Patent Application Laid-Open No. 2006-137564, the operating time of the pressure plate is constant irrespective of a stacked amount. Therefore, it is difficult to apply the technique disclosed in Japanese Patent Application Laid-Open No. H03-079537.

SUMMARY OF THE INVENTION

Thus, the object of the invention is to provide a feeder capable of detecting the stacked amount of sheets without adding a dedicated sensor or the like, in the feeder which keeps constant the operating amount of a pressure plate and stabilizes the feed performance of sheets.

In order to solve the above problems, the invention provides a sheet feeding apparatus including a feeding unit which abuts on a sheet and feeds the sheet; a pressure plate having sheets stacked thereon, and turnably supported so that a sheet on the uppermost layer among the stacked sheets abut on the feeding unit; a biasing unit which biases the pressure plate in order to bring the sheets stacked on the pressure plate into pressure contact with the feeding unit; a separating unit which depresses the pressure plate against the biasing force of the biasing unit and separates the sheet from the feeding unit by a predetermined distance; a separation driving unit which drives the separating unit; a measuring unit which measures the driving load applied to the separation driving unit when the separation driving unit drives the separating unit; and a load imparting unit which imparts load to at least any one of the pressure plate, the separating unit, and the separation driving unit. Moreover, the load imparting unit imparts load when the sheet is separated from the feeding unit by the separating unit, and the load imparting unit changes the load to be imparted, according to the turning angle of the pressure plate.

According to the invention, it is possible to change the load of the separating operation of separating a sheet on the pressure plate from the feeding unit according to the turning angle of the pressure plate, thereby measuring a difference in driving load according to the angle of the pressure plate during separating operation, i.e., the stacked amount of sheets, and calculating the rough stacked amount simply from the measurement result. Additionally, since it is possible to calculate the measurement of the driving load from the PWM duty of motor driving, there is also no necessity of newly providing dedicated measuring unit. For this reason, it is possible to detect the sheet residual amount with a simple construction while suppressing a cost increase caused by the addition of a sensor.

Further features of the present invention will become apparent from the following description of exemplary embodiments with reference to the attached drawings.

DESCRIPTION OF THE EMBODIMENTS

An embodiment of a sheet feeding apparatus of the invention will now be described in detail with reference to the accompanying drawings. Here, although an ink jet printer to which the sheet feeding apparatus of the invention is applied will be described as an example, it is also possible to apply the sheet feeding apparatus of the invention to apparatuses other than the ink jet printer.

Figure 1:
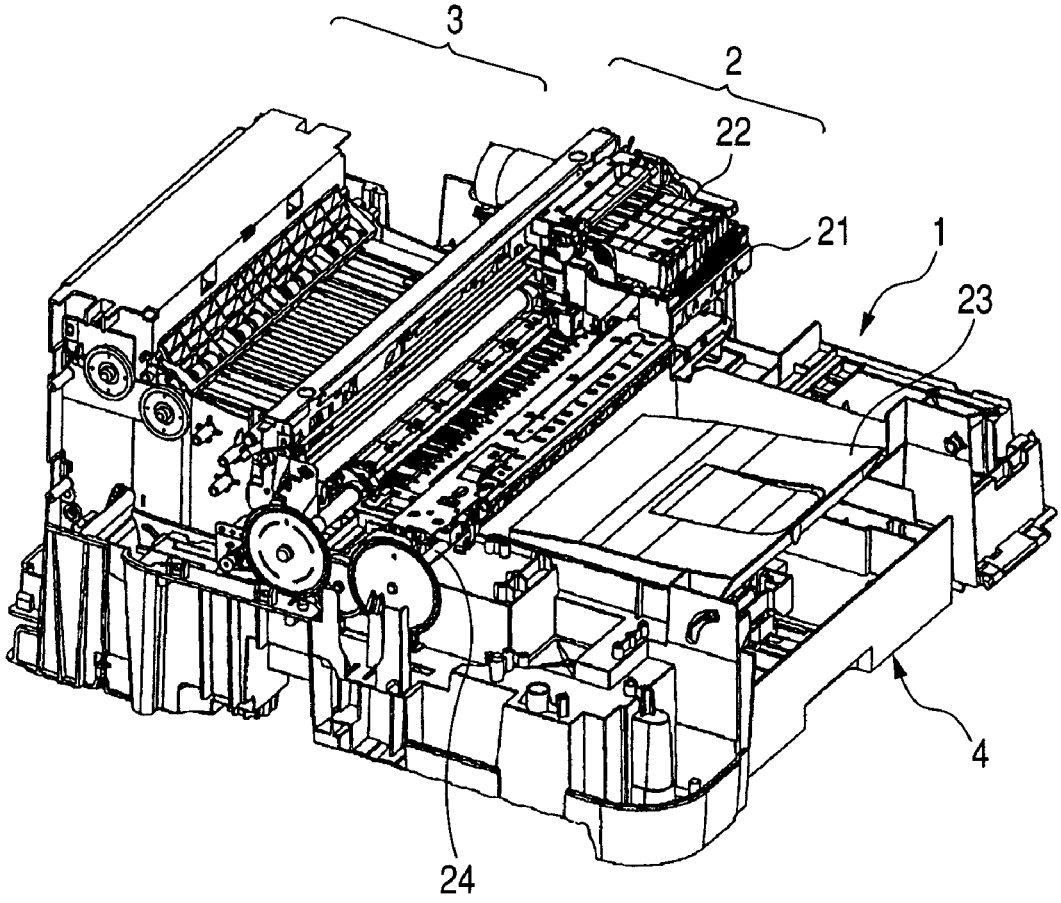
FIG. 1 is a perspective view illustrating the construction of a main body of an ink jet printer including a sheet feeding apparatus according to an embodiment of the invention.
Figure 2:
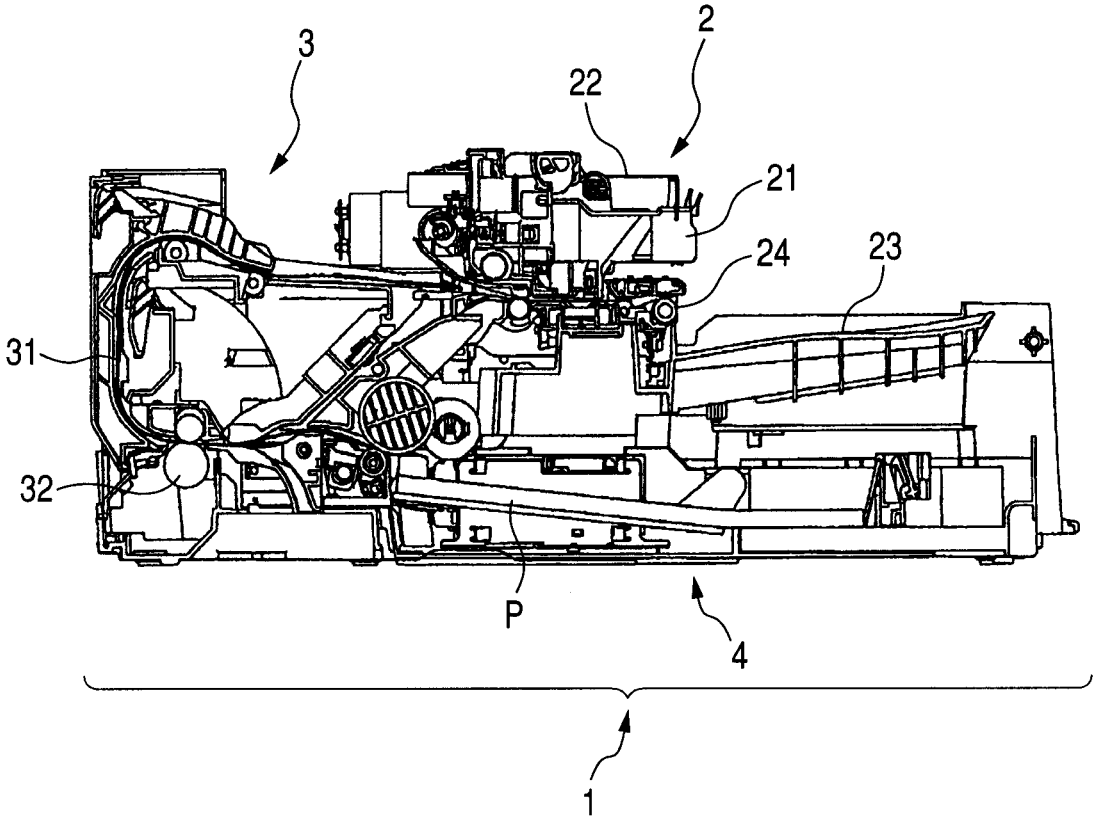
FIG. 2 is a sectional view of the main body of the ink jet printer of FIG. 1.

FIG. 1 is a perspective view illustrating the main internal configuration of an ink jet printer using the sheet feeding apparatus of the invention, and FIG. 2 is a sectional view illustrating main portions of the ink jet printer.

A main body 1 of the ink jet printer illustrated in FIGS. 1 and 2 includes a recording unit 2 which discharges ink drops to the surface of a sheet, thereby forming an image, and a sheet feeding apparatus 4 which separates and feeds recording paper sheets P which are the sheets stacked within the apparatus one by one. A recording paper P separated and fed from the sheet feeding apparatus 4 is nipped by conveying rollers 32 arranged on a conveying path 31, and is conveyed to a recording unit 2 arranged on the downstream side of the conveying path.

A carriage 21 which operates to reciprocate in a direction orthogonal in a paper conveying direction is disposed at the recording unit 2, and the carriage 22 holds a head (not illustrated) which discharges ink to a recording paper sheet and an ink tank 22 which supplies ink to the head.

In such an ink jet printer, after the leading end position of a paper sheet conveyed from a conveying unit 3 is conveyed to a predetermined position, an ink drop is discharged from the head while the carriage 21 moves in the direction orthogonal to the recording paper conveying direction, and the image data for a predetermined line is recorded on the paper. Thereafter, the paper sheet is conveyed by a predetermined line and the next image data is recorded. The above sequence is repeated until the recording data for one sheet ends, and if the recording for one sheet ends, the paper sheet is ejected to a sheet ejection tray 23 by a sheet ejection roller 24.

Figure 3:
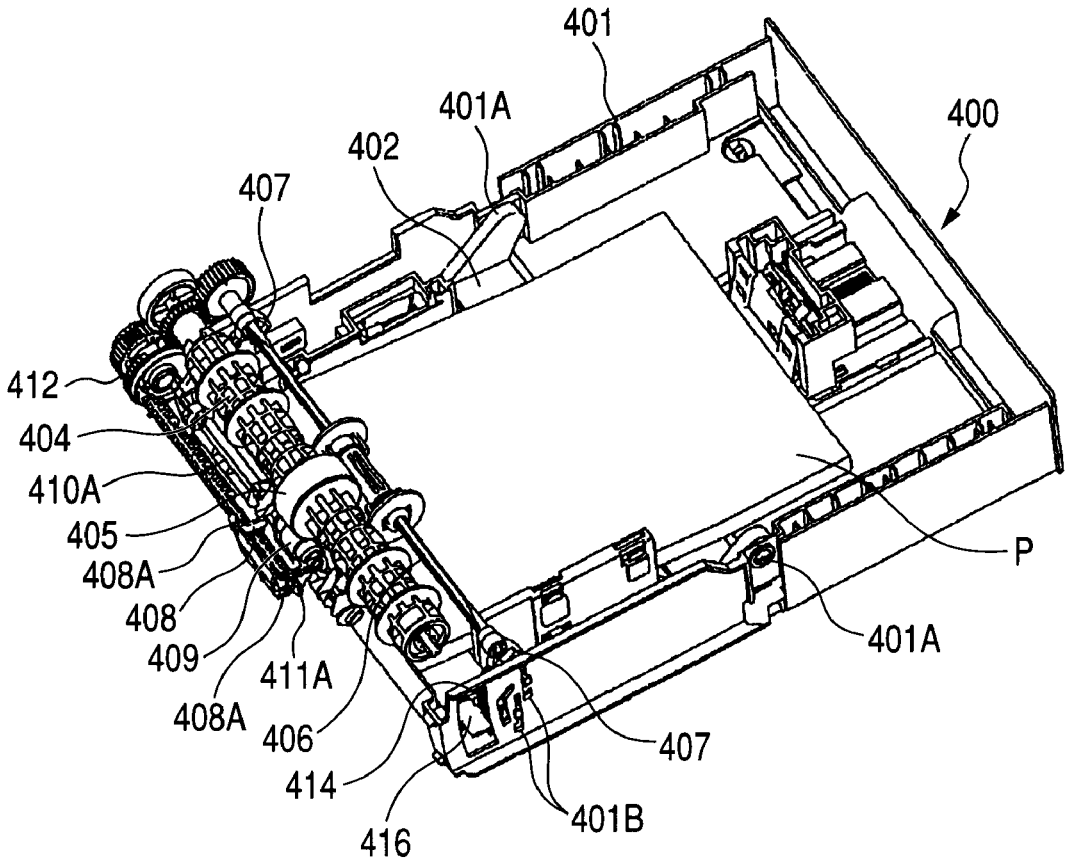
FIG. 3 is a perspective view illustrating the sheet feeding apparatus of FIG. 1.
Figure 4A:
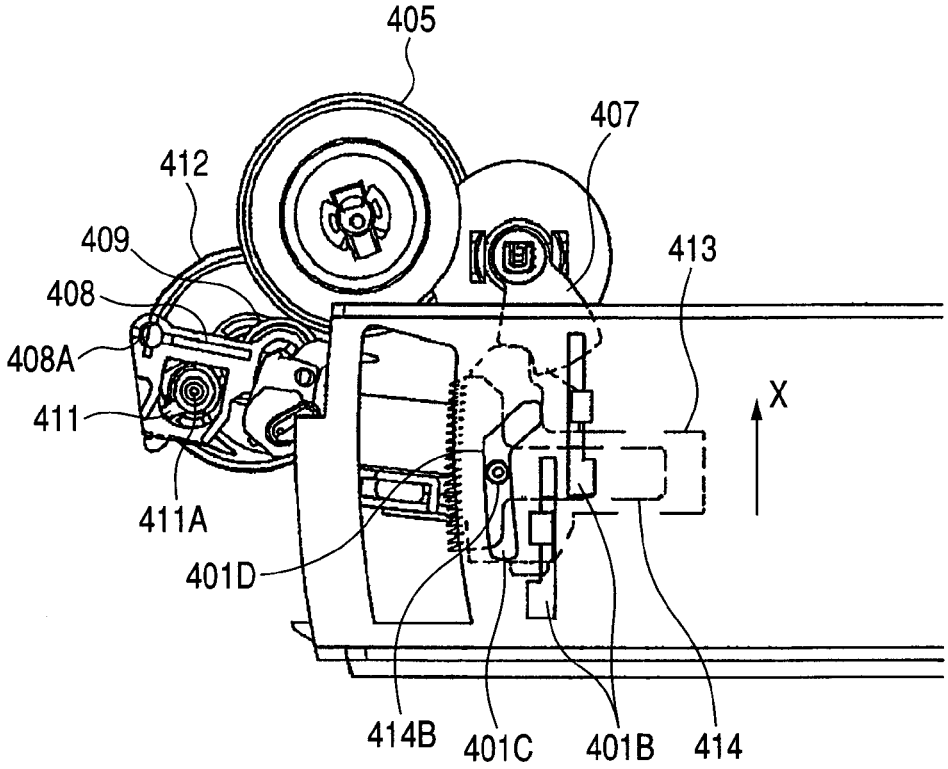
FIGS. 4A, 4B, 4C and 4D are sectional views of the sheet feeding apparatus of FIG. 3.
Figure 4B:
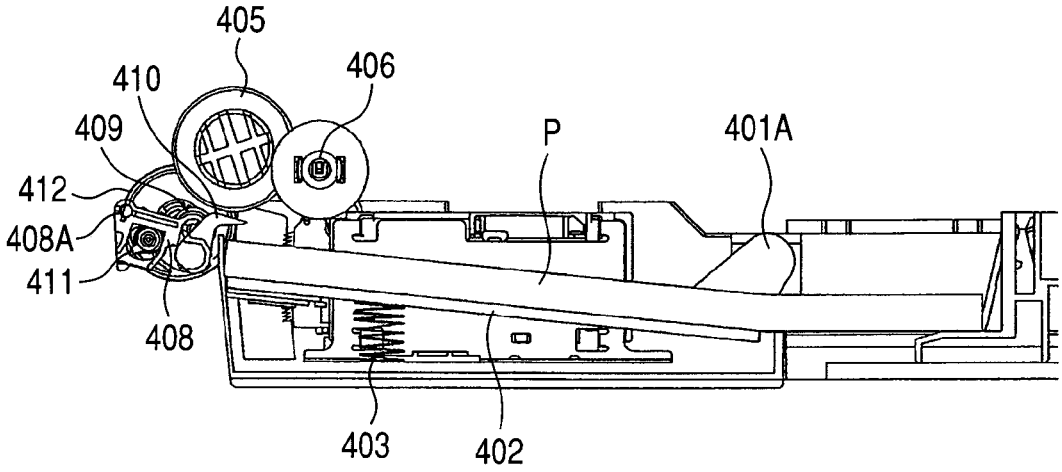
Figure 4C:
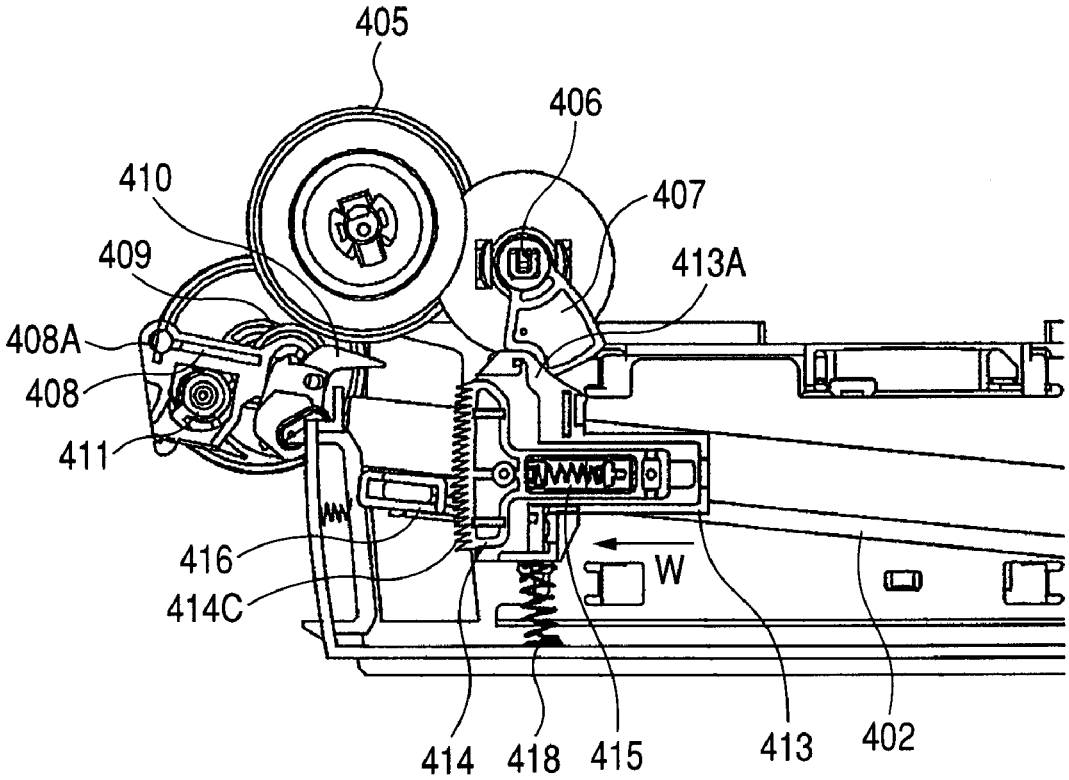
Figure 4D:
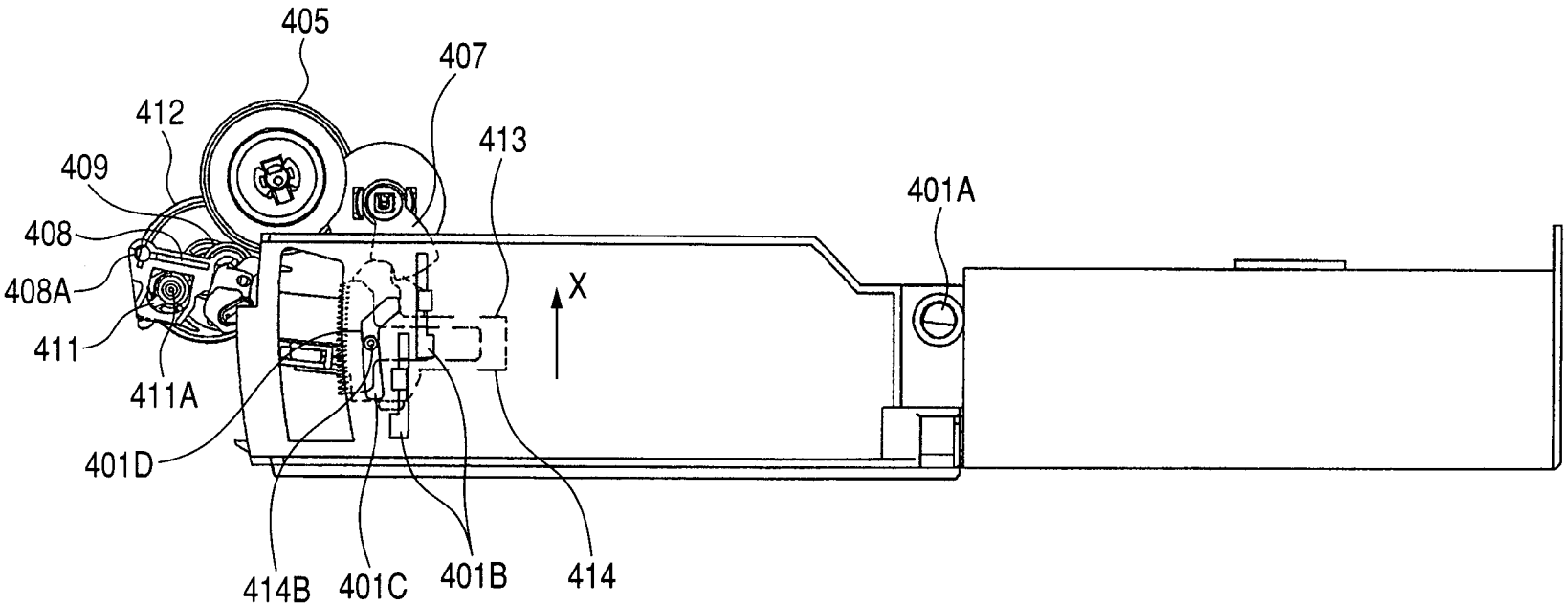

FIG. 3 is a perspective view of the sheet feeding apparatus 4, and sectional views of the sheet feeding apparatus are illustrated in FIGS. 4A to 4D. FIGS. 4A and 4D are sectional views illustrating the profile of a cassette 400, FIG. 4B is a sectional view illustrating the state of rollers or the like, and FIG. 4C is a sectional view illustrating a depressing operation of a middle plate. The sheet feeding apparatus 4 is assembled into the above-described ink jet printer which is an image forming apparatus, and is able to feed so-called fixed size sheets, such as A4, letter (LTR), and legal (LGL).

First, the construction of the present embodiment will be described. As illustrated in FIG. 3, a sheet feeding cassette 400, which is constructed as a box-shaped frame 401 and has an open upper face, is adapted to be attachable to and detachable from the right of FIG. 2 along a cassette guide (not illustrated) provided at the main body of the ink jet printer. A middle plate 402 serving as a pressure plate which has an end rockably journalled by a pivot 401A is arranged inside the frame 401 of the sheet feeding cassette 400. As illustrated in FIG. 4B, a coil spring 403 serving as a biasing unit is arranged between the middle plate 402 and the bottom of the frame 401, and the middle plate 402 is biased in the direction of an arrow X in FIG. 4D by the resilient force of the coil spring 403.

A sheet feeding roller shaft 404 supported by the frame of the main body of the printer is arranged above the end of the middle plate 402 opposite to the pivot 401A. A sheet feeding roller 405 is attached to the sheet feeding roller shaft 404 as a feeding unit.

When the middle plate 402 is biased and turned in the direction of the arrow X by the resilient force of the coil spring 403, a paper P1 on the uppermost layer among the paper sheets P stacked on the middle plate 402 abuts the sheet feeding roller 405, and the turning of the middle plate 402 is stopped, thereby bringing the paper sheet into a feeding allowable state.

Additionally, a separation roller 409 is arranged to face the sheet feeding roller 405, and the separation roller 409 is supported by a holder 408 which is rockable about a pivot 408A. The holder 408 is biased toward the sheet feeding roller 405 by a spring (not illustrated), and as a result, the separation roller 409 and the sheet feeding roller 405 maintain the state of being brought into pressure contact with each other. The separation roller 409 is supported by the holder 408 via a torque limiter (not illustrated), and is adapted to rotate with respect to the holder 408 at a predetermined torque or more. Then, when the sheet feeding roller 405 is rotationally driven, the paper P stacked on the middle plate 402 is fed into a nip portion between the sheet feeding roller 405 and the separation roller 409. In a case where the paper sheet led to the nip portion is a single sheet, the separation roller 409 is rotated to follow the paper sheet to be fed. However, in a case where two sheets of paper are overlappingly fed, the frictional force caused by the torque limiter surpasses the frictional force between paper sheets, the rotation of the separation roller 409 is stopped, the lower paper sheet of the overlapped paper sheets is blocked by the separation roller 409, and only the paper sheet on the uppermost layer is conveyed to the downstream.

Additionally, a return lever 410, which pushes the paper sheets back to the cassette after a second sheet of paper has been projected to the downstream from the sheet feeding cassette 400 by the paper feeding operation, is provided, and the return lever 410 is adapted to be turnable about the pivot 410A and movable up and down.

The tip of the return lever 410 is arranged so as to draw a turning locus such that the tip of the return lever retreats to the outside of a paper passing path on the downstream side with respect to the nip portion between the sheet feeding roller 405 and the separation roller 409, enters the paper passing path in the vicinity of the nip portion, and retreats to the outside of the paper passing path again on the upstream side.

Additionally, a holder release lever 411 is provided to be engageable with and separable from the holder 408, and is adapted to be turnable about the pivot 411A. In a case where the holder release lever 411 is at a position where the holder release lever engages with the holder 408, the holder 408 is turned in a direction in which the holder is separated from the sheet feeding roller 405 against a spring force, and consequently, the separation roller 409 is separated from the sheet feeding roller 405. On the other hand, in a case where the holder release lever 411 is at a position where the holder release lever is separated from the holder 408, the holder 408 maintains the pressure contact state between the sheet feeding roller 405 and the separation roller 409 by a spring force.

Cam followers (not illustrated) are respectively provided at the end of the pivot 410A of the lever 410 and the end of the pivot 411A of the holder release lever 411. Each cam follower engages with the cam face of the control cam 412, and the cam face is formed so that the return lever 410 and the holder 411 perform a desired paper separating operation according to the rotation of the control cam 412.

An example of a separating unit which constitutes the sheet feeding apparatus of the invention and a separation driving unit which moves the separating unit will now be described.

A depressing cam shaft 406 is provided on the upstream side in the conveying direction of the sheet feeding roller shaft 404, and depressing cams 407 are attached to the positions where the depressing cams do not interfere with the recording paper P outside the sheet width of the recording paper P on the middle plate 402, at both ends of this cam shaft.

Additionally, provided is a depressing slider 413 which is adapted to be movable up and down (the X direction or its opposite direction in the drawing) with respect to the sheet feeding cassette 400. The depressing slider 413 is attached so as to be movable up and down as the depressing slider is attached to and guided by a slide guide 401B provided in the shape of a vertically long punching hole in the frame 401. An upper portion of the depressing slider 413 is formed with an upper end projection 413A, and the upper end projection 413A is adapted to be always brought into sliding contact with the outer peripheral cam face of the depressing cam 407 as the depressing slider 413 is biased upward by the coil spring 418. Therefore, as the depressing cam 407 rotates, the depressing slider 413 is rocked in the direction of the arrow X along the slide guide 401B along the cam profile of the depressing cam 407.

Figure 5A:
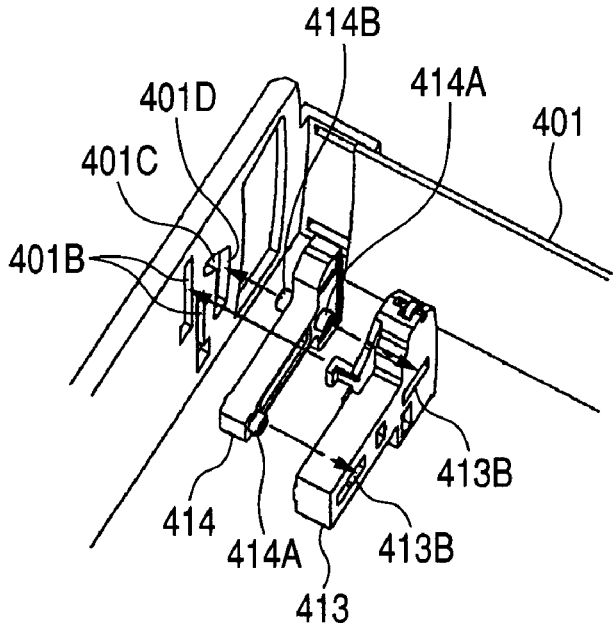
FIGS. 5A and 5B are explanatory views of the periphery of a depressing claw of FIGS. 4A, 4B, 4C and 4D.

Additionally, a depressing claw 414 is provided inside the depressing slider 413. FIG. 5A is a view illustrating the construction of the depressing slider 413 and the depressing claw 414. By making a guide hole 413B provided in the depressing slider 413 engage with a guide shaft 414A of the depressing claw 414, the depressing claw 414 is adapted to be movable in the direction of an arrow W in the drawing orthogonal to the rocking direction of the depressing slider 413, or its opposite direction. On the other hand, a guide shaft 414B is formed at the depressing claw 414, and engages with a guide hole 401C provided in the frame 401. The depressing claw 414 is always biased in the W direction by a spring 415, and the guide shaft 414B of the depressing claw 414 is positioned as the guide shaft is brought into sliding contact with a cam face 401D of the guide hole 401C. The end of the depressing claw 414 is provided with a claw portion 414C of which the tip is formed toward the movement direction (the W direction), and a middle plate claw 416 is attached to the tip side of the middle plate 402 so as to face the claw portion 414C. The middle plate claw 416 is adapted to be slidable with respect to the middle plate 402, and is biased in a direction in which the middle plate claw approaches the depressing claw 414 by a spring (not illustrated).

Then, as the depressing slider 413 moves up and down, the shaft 414B slides on the cam face 401D, and the depressing claw 414 moves. When the depressing slider 413 moves up, the depressing claw 414 moves in a direction (direction opposite to the arrow W in the drawing) in which the depressing claw is separated from the middle plate claw 416 against the resilient force of the spring 415. On the other hand, when the depressing slider 413 rocks downward, the claw portion 414C of the depressing claw 414 moves so as to engage with the middle plate claw 416 by the resilient force of the spring 415, and the engaged middle plate claw 416 is depressed to rock the middle plate 402 by a predetermined amount in the direction opposite to the arrow X. In addition, when the claw portion 414C of the depressing claw 414 engages with the middle plate claw 416, the depressing claw 414 pushes the middle plate claw 416 in a sliding direction (W direction in the drawing) against the biasing force of the spring 417, and the middle plate claw 416 slides to a position where the middle plate claw abuts against an abutting portion (not illustrated) of the middle plate 402.

Figure 5B:
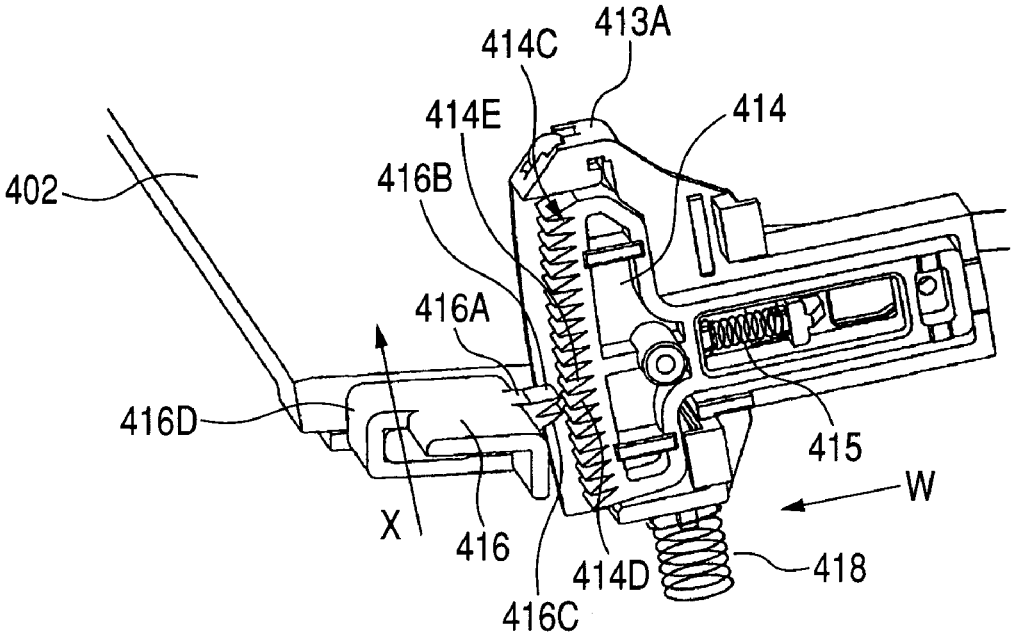

FIG. 5B is a view illustrating the periphery of the depressing claw 414 and the middle plate claw 416. As illustrated in FIGS. 5A and 5B, the claw portion 414C of the depressing claw 414 includes a locking face 414D and a tapered face 414E, respectively, and a claw portion 416A of the middle plate claw 416 also includes a locking face 416B and a tapered face 416C, respectively.

When the middle plate 402 is intended to rock in the direction opposite to the arrow X, since the tapered face 414E of the depressing claw 414 and the tapered face 416C of the middle plate claw 416 engage with each other, the depressing claw 414 escapes in the direction opposite to the arrow W, and the middle plate 402 is rockable without being regulated in movement. Additionally, when the middle plate 402 is intended to rock in the direction of the arrow X, the locking face 414D of the depressing claw 414 and the locking face 416B of the middle plate claw 416 engage with each other, the depressing claw 414 is not able to move in the direction opposite to the arrow W, and the rocking of the middle plate 402 is regulated. In this way, the claw portion 414C of the depressing claw 414 and the claw portion 416A of the middle plate claw 416 constitute a ratchet mechanism in which movement in one direction is regulated and movement in the other direction is free.

Additionally, the sheet feeding roller 405, the depressing cam 407, and the control cam 412 (FIG. 3) are rotationally driven by receiving the driving from a sheet feeding motor 324 (FIG. 10), which is a driving source connected through gears.

In addition, the sheet feeding cassette 400 is provided with a middle plate locking mechanism (not illustrated) for locking the middle plate 402 at a depressed position when the middle plate 402 is depressed downward in a state where the sheet feeding cassette is pulled out of the main body 1 of the ink jet printer. Thereby, it is possible to secure a wide stacking space for the paper P, thereby easily setting the paper P on the middle plate 402. Then, when the sheet feeding cassette 400 is mounted on the main body 1 of the ink jet printer in a state where the middle plate 402 is locked by the middle plate locking mechanism, the locking of the middle plate 402 by the middle plate locking mechanism is released by a middle plate unlocking portion (not illustrated) formed in the cassette guide during the mounting.

Next, a series of sheet feeding operations in the sheet feeding apparatus 4 which is a first embodiment will be described with reference to FIGS. 6A to 8D. FIGS. 6A to 6D show a case (when paper sheets are fully stacked) where the stacked amount of paper sheets stacked on the middle plate 402 is large, FIGS. 7A to 7D show a case (when stacked at a medium level) where the stacked amount of paper sheets is about the half, and FIGS. 8A to 8D show a case (when stacked at a low level) where the stacked amount of paper sheets is small.

When the middle plate 402 is depressed in a state where the sheet feeding cassette 400 is pulled out of the main body 1 of the ink jet printer, the middle plate 402 is locked by the middle plate locking mechanism (not illustrated), and a bundle of paper sheets is set on the middle plate 402 in that state. Next, when the sheet feeding cassette 400 is mounted on the main body 1 of the ink jet printer, the locking of the middle plate locking mechanism is released by the middle plate unlocking portion. At this time, the depressing slider 413 attached to the sheet feeding cassette 400 is mounted in a state where the depressing slider has abutted on the depressing cam 407 attached to the depressing cam shaft 406.

Figure 6A:
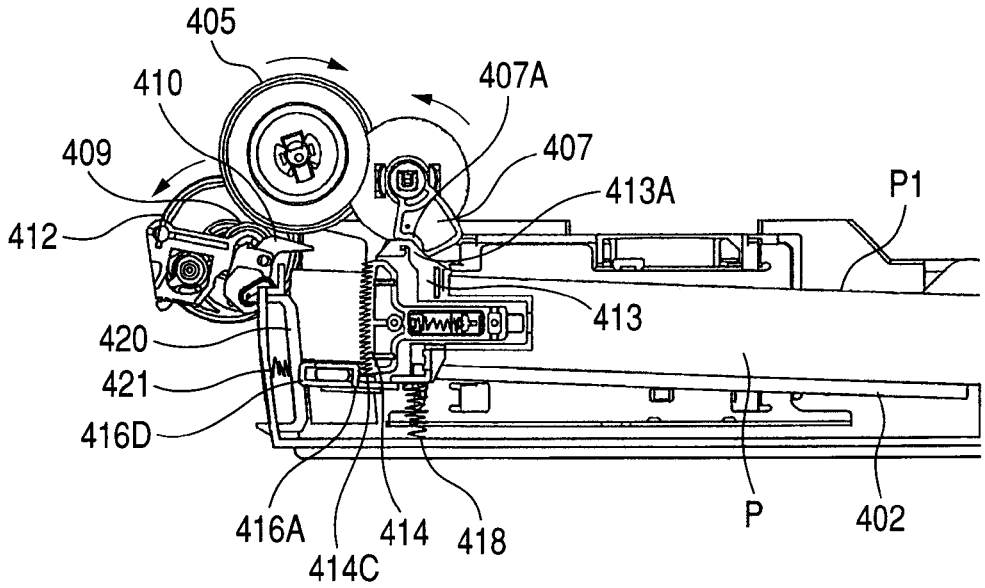
FIGS. 6A, 6B, 6C and 6D are explanatory views of the sheet feeding operation when paper sheets are fully stacked within a cassette of FIG. 3.
Figure 7A:
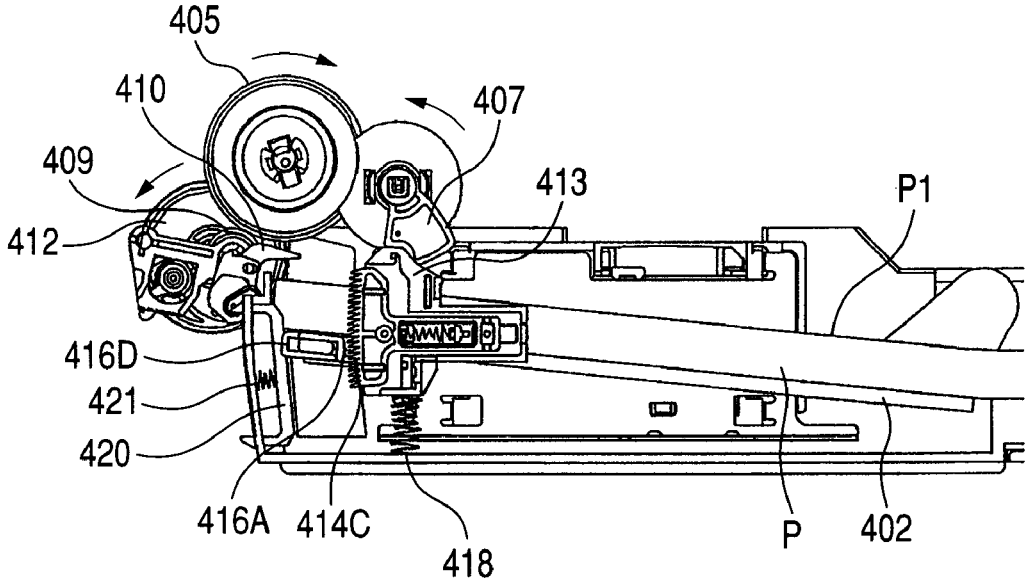
FIGS. 7A, 7B, 7C and 7D are explanatory views of the sheet feeding operation when paper sheets are stacked at a medium level within the cassette of FIG. 3.
Figure 8A:
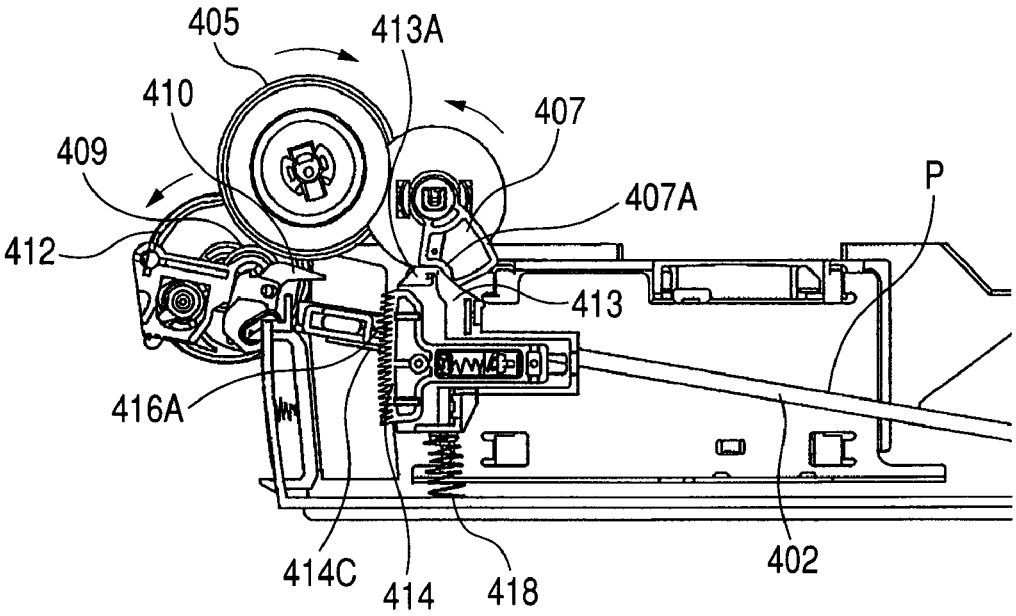
FIGS. 8A, 8B, 8C and 8D are explanatory views of the sheet feeding operation when paper sheets are stacked at a low level within the cassette of FIG. 3.

As illustrated in FIGS. 6A, 7A, and 8A, when the sheet feeding cassette 400 is mounted to a predetermined position, the upper end projection 413A provided on the depressing slider 413 engages with a recess 407A of the depressing cam 407, which leads to a standby state. In this state, the claw portion 414C of the depressing claw 414 engages with the claw portion 416A of the middle plate claw 416, and the upper face of the stacked paper sheets P and the sheet feeding roller 405 are separated from each other. Additionally, the separation roller 409 is brought into pressure contact with the sheet feeding roller 405, and the return lever 410 is on the upstream side of the separation roller, i.e., at a position where a paper sheet is prevented from entering the nip portion between the sheet feeding roller 405 and the separation roller 409.

When the sheet feeding motor 324 which is a driving source (not illustrated) begins to rotate on the basis of a sheet feeding signal, the sheet feeding roller 405, the depressing cam 407, and the control cam 412 rotate via a gear train. As indicated by arrows in the drawings, the sheet feeding roller 405 rotates clockwise, and the depressing cam 407 and the control cam 412 rotate counterclockwise. Since the depressing slider 413 is biased upward by the resilient force of the coil spring 418 and the upper end projection 413A always abuts on the depressing cam 407, the upper end projection 413A moves along the profile of the depressing cam 407. Thereby, the depressing slider 413 rocks upward along the slide guide 401B, and the depressing claw 414 attached to the depressing slider 413 also rocks upward similarly to the depressing slider 413. At this time, the return lever 410 moves to a retreat position out of the paper passing path on the downstream side of the separation roller as the cam follower which engages with the cam face of the control cam 412 turns along the cam face.

Figure 6B:
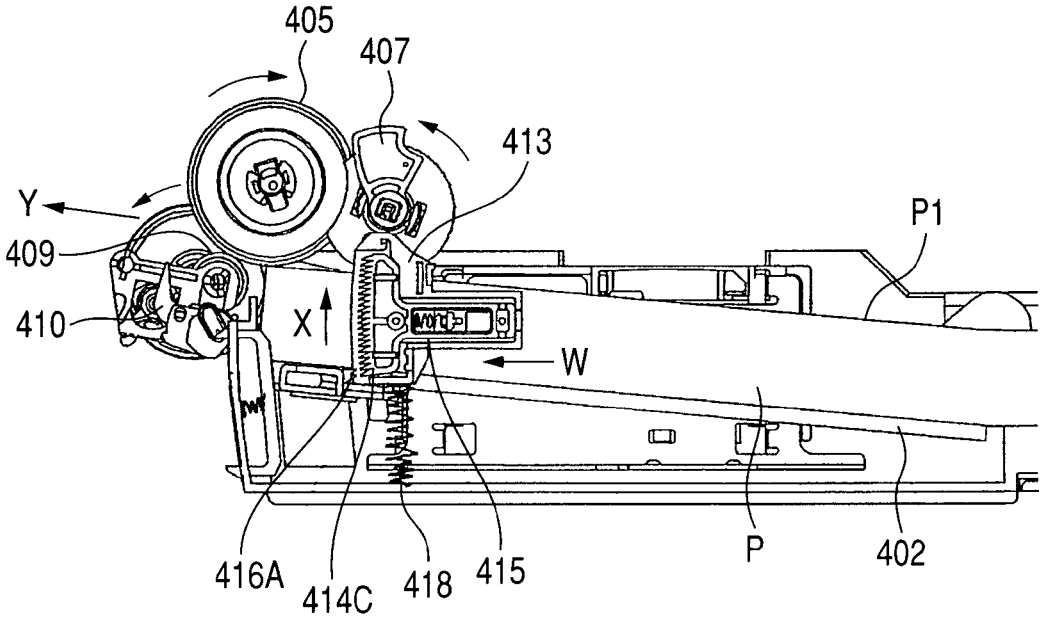
Figure 7B:
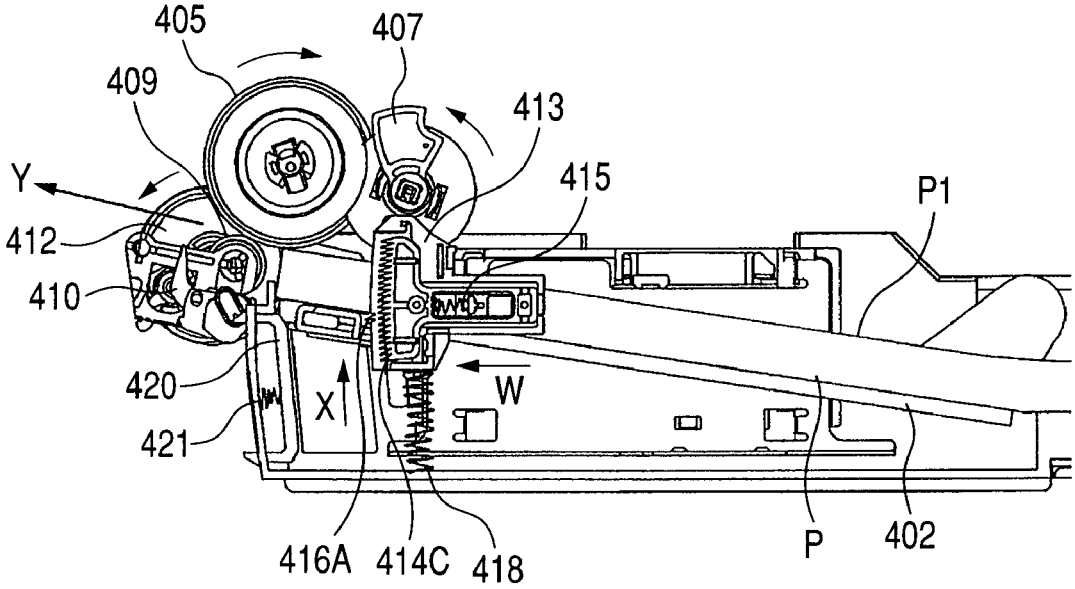
Figure 8B:
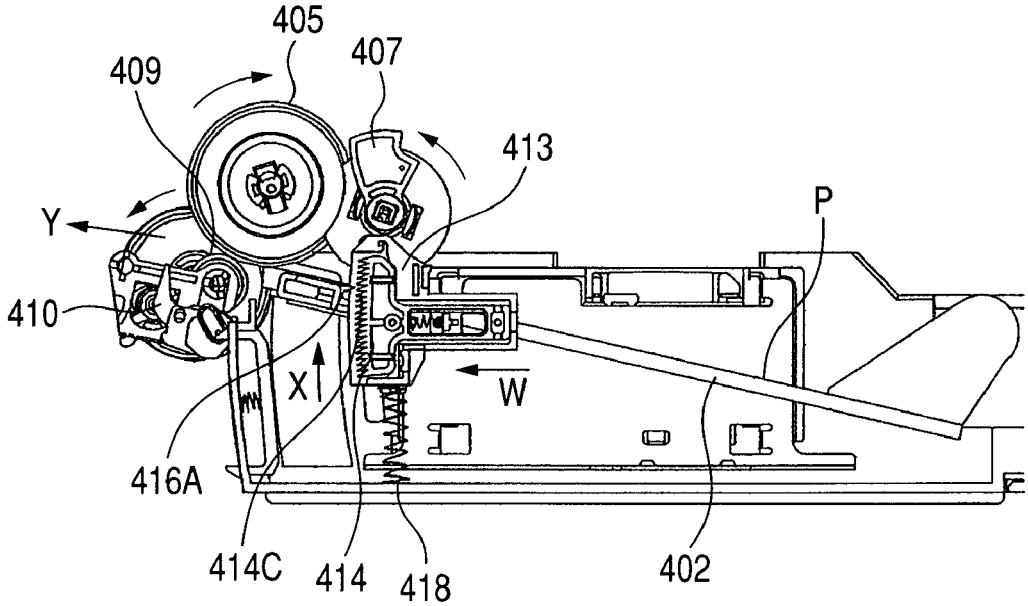

When the sheet feeding roller 405 is further rotated, the depressing slider 413 rocks further upward. Then, the shaft 414B of the depressing claw 414 slides on the cam face 401D of the frame 401, and the depressing claw 414 moves substantially horizontally in the direction opposite to the arrow W inside the depressing slider 413 along the cam face 401D. Thereby, the depressing claw 414, and the middle plate claw 416 attached to the middle plate 402 are disengaged from each other, and the regulation of the middle plate 402 is released. Since the middle plate 402 is always biased upward by the coil spring 403, when the regulation is released, the middle plate 402 ascends in the direction of the arrow X about the pivot 401A. Then, the uppermost paper P1 stacked on the middle plate 402 is brought into pressure contact with the sheet feeding roller 405 (FIGS. 6B, 7B, and 8B). As the sheet feeding roller 405 rotates further, the paper P1 is fed in the direction of an arrow Y in the drawings due to the friction between the sheet feeding roller 405 and the uppermost paper P1.

When the delivered paper sheet reaches a position between the sheet feeding roller 405 and the separation roller 409, the paper sheet is separated one by one as described above at the nip portion. The depressing cam 407 rotates further and begins to depress the upper end projection 413A of the depressing slider 413. The depressing slider 413 moves downward along the guide 401B formed on the sheet feeding cassette 400 against the resilient force of the spring 418. When the depressing slider 413 rocks downward, the depressing claw 414 moves in the direction of the arrow W within the depressing slider 413 by the coil spring 415 while the guide shaft 414B is brought into sliding contact with the cam face 401D (FIG. 5A).

Figure 6C:
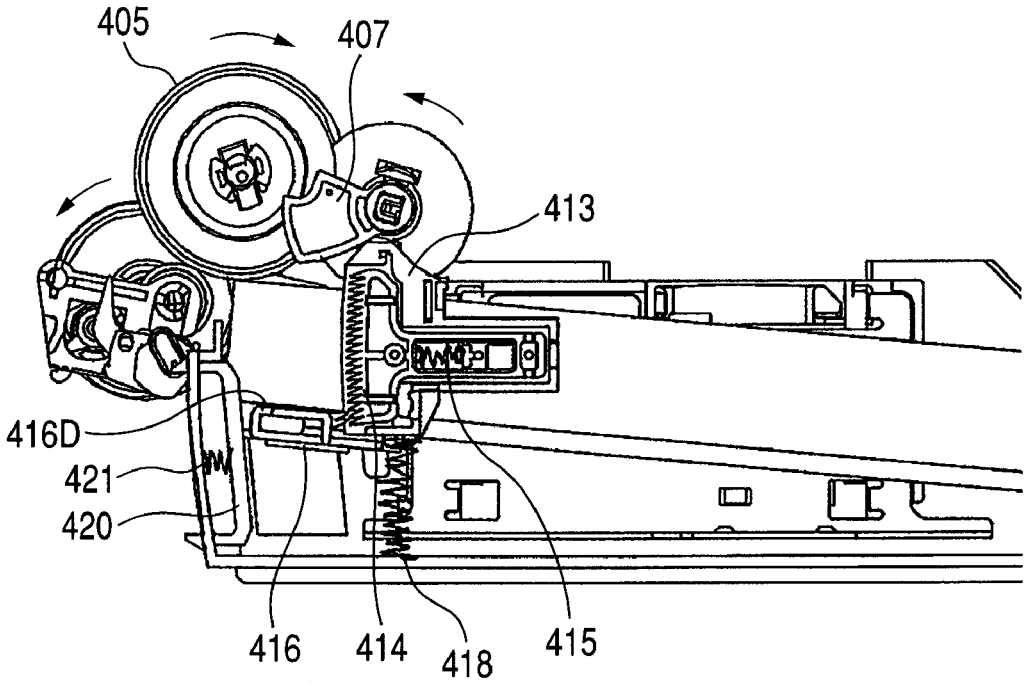
Figure 6D:
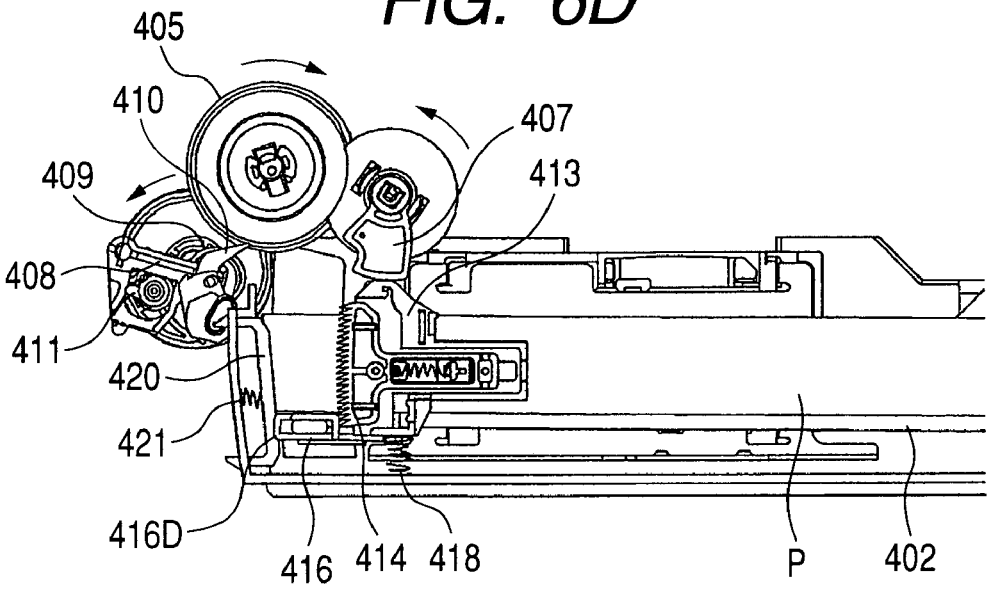
Figure 7C:
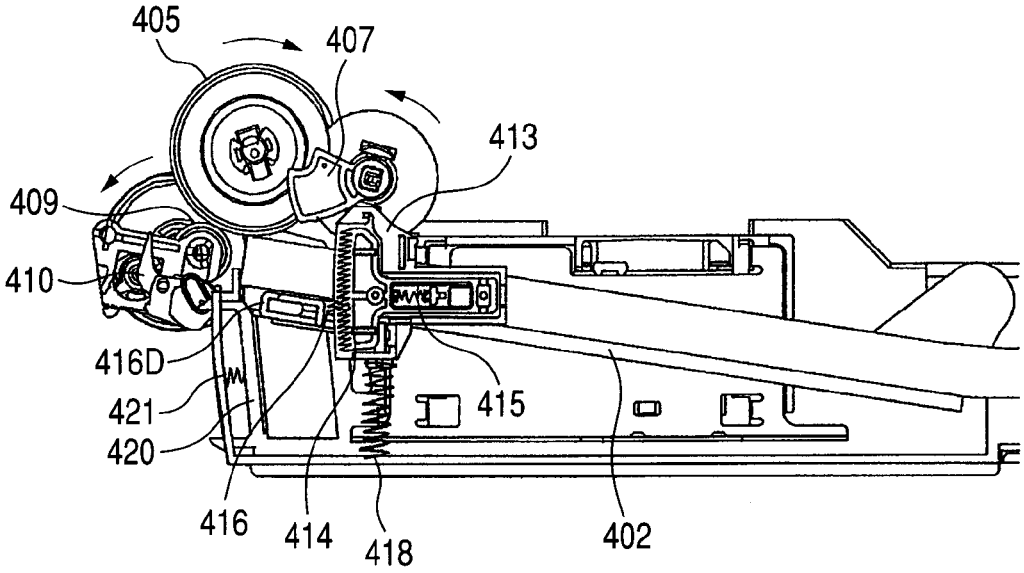
Figure 7D:
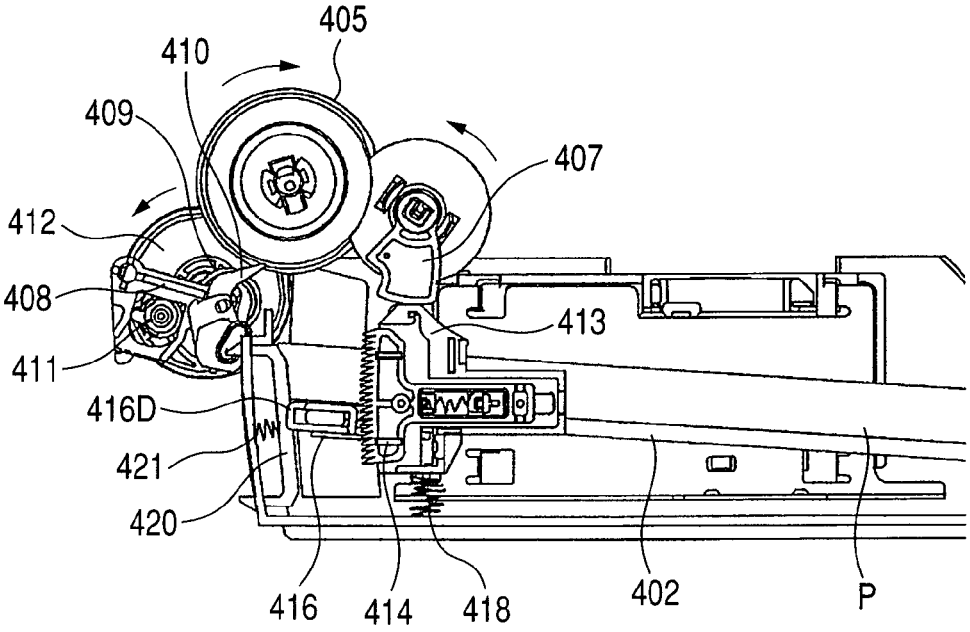
Figure 8C:
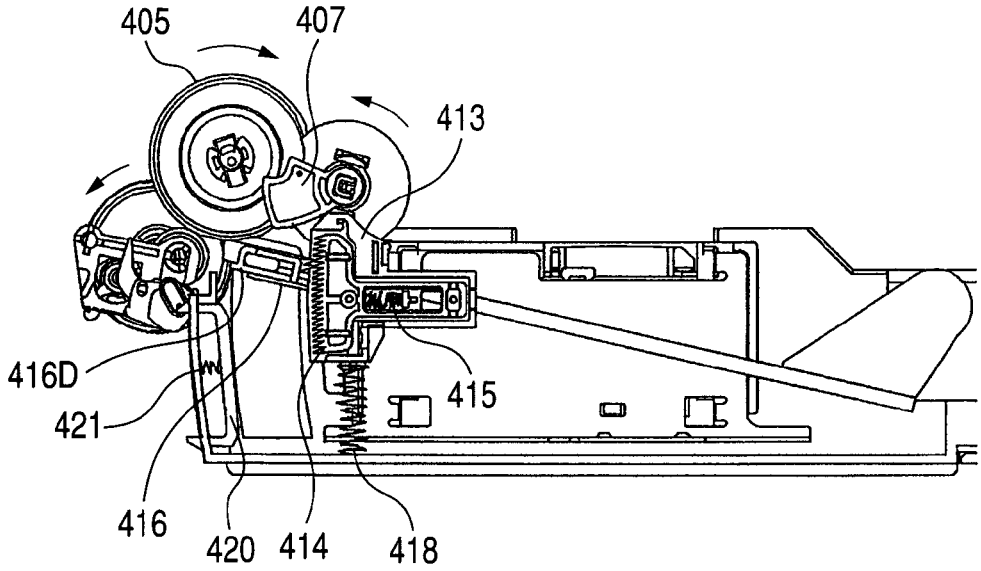
Figure 8D:
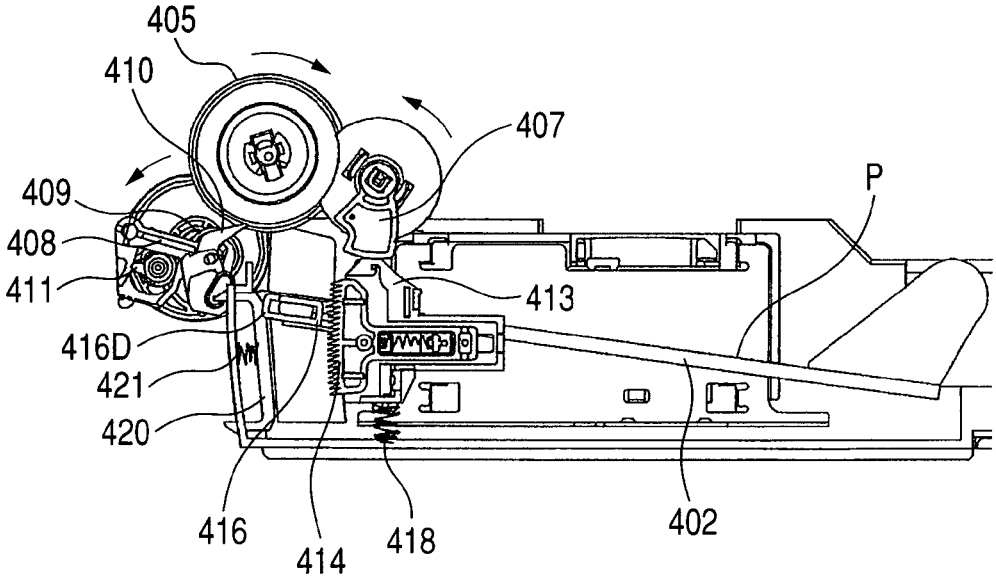

Then, the depressing claw 414, and the middle plate claw 416 attached to the middle plate 402, begin to engage with each other (FIGS. 6C, 7C, and 8C). When the rotation of the depressing cam 407 proceeds further, the locking face 414D (FIG. 5B) of the depressing claw 414 and the locking face 416B (FIG. 5B) of the middle plate claw 416 engage with each other. Moreover, with the descent of the claw portion 414C of the depressing claw 414, the middle plate claw 416 also descends and the middle plate 402 is depressed (FIGS. 6D, 7D, and 8D).

By rocking the depressing slider 413 downward by the depressing cam 407 in this way, the middle plate claw 416 is depressed. Thereby, the middle plate 402 is rocked in the direction opposite to the arrow X against the resilient force of the coil spring 403, and a predetermined separation distance is created between the sheet feeding roller 405 and the uppermost face of the paper sheet with a predetermined gap distance left between the upper face of the uppermost paper P1 on the middle plate 402, and the sheet feeding roller 405. In that case, the above return lever 410 moves to the nip portion between the sheet feeding roller 405 and the separation roller 409 while the cam follower (not illustrated) turns along the cam face of the control cam 412, and enters a paper conveying path. Simultaneously, the cam follower (not illustrated) turns along the cam face of the control cam 412, and the holder release lever 411 separates the separation roller 409 journalled to the holder 408 from the sheet feeding roller 405. After the separation roller 409 is separated from the sheet feeding roller 405, the cam follower (not illustrated) turns further along the cam face of the control cam 412, and the return lever 410 retreats to the outside of the conveying path on the upstream side of the separation roller 409.

Through the series of movements of the return lever 410 described above, the paper sheets after a second sheet of paper blocked by the nip portion between the sheet feeding roller 405 and the separation roller 409 are pushed back to the inside of the sheet feeding cassette by the tip of the return claw 410. Thereafter, the cam follower (not illustrated) turns further along the cam face of the control cam 412 of the holder release lever 411. The separation roller 409 journalled to the holder 408 is brought into pressure contact with the sheet feeding roller 405 again, and conveys one separated recording paper sheet while nipping the paper sheet by the nip portion between the separation roller and the sheet feeding roller 405. In this way, the operation of separating and feeding one paper from the paper sheets stacked within the sheet feeding cassette 400 is reliably performed.

Thereafter, when the sheet feeding roller 405 is further rotated, as illustrated in FIGS. 6A, 7A, and 8A, the upper end projection 413A provided on the depressing slider 413, and the recess 407A of the depressing cam 407 engage with each other. The sheet feeding roller 405 is held at an initial standby position (home position) by the engagement between the upper end projection 413A and the recess 407A, and a series of separating operations ends. A series of operations until a predetermined separation distance is created between the upper face of the paper sheets P and the sheet feeding roller 405 and returning to the standby position is made from the start of engagement between the depressing claw 414 and the middle plate claw 416 described above is hereinafter referred to as "predetermined distance separating operation".

Then, the uppermost paper P1 is nipped by the sheet feeding roller 405 and the separation roller 409, and is separated and conveyed toward a pair of conveying rollers 32 provided on the downstream side, and the paper sheet is further conveyed to the recording unit 2 by the pair of conveying rollers 32. Then, when the sheet feeding roller 405 is subsequently rotated, it is possible to feed the following paper sheets P continuously similarly to the above.

Additionally, in the present embodiment, a brake plate 420 is provided at a position corresponding to the middle plate claw 416 below the tip side of the cassette frame 401 in the feed direction. The brake plate 420 is biased in the direction of the middle plate claw 416 by the spring 421. The brake plate 420 is arranged so as to be brought into pressure contact with and slide on a sliding portion 416D provided at the tip of the middle plate claw 416 during the descent (Refer to FIGS. 6D, 7D, and 8D) when the middle plate claw 416 descends according to the turning of the middle plate 402 in a state where the middle plate claw 416 is pushed by the depressing claw 414 and is pushed out in the feed direction. In addition, one of the sliding portion 416D of the middle plate claw 416 and the brake plate 420 is made of a rubber material (for example, silicon rubber) with a high sliding resistance.

Since the brake plate 420 is provided below the frame 401, only when the tip of the middle plate 402 turns to below the frame 401 and the middle plate claw 416 is moved further in the direction of the brake plate 420, the brake plate 420 and the sliding portion 416D are brought into pressure contact with and slide on each other. That is, the brake plate and the sliding portion are brought into pressure contact with and slides on each other during the predetermined distance separating operation. The function of the brake plate 420 will be described later.

In the ascent/descent operation of the middle plate 402 described above, as illustrated in FIGS. 6A to 8D, even if the stacked amount (stacked height) of the paper sheets P stacked on the middle plate 402 becomes different, the position where a plurality of claw portions 414C provided at the depressing claw 414 and the claw portion 416A of the middle plate claw 416 engage with each other varies. Thereby, the middle plate 402 is separated from the sheet feeding roller 405 with almost the same timing as the start of rotation of the sheet feeding roller 405. Moreover, it is possible to perform a predetermined separation distance between the uppermost face of the paper sheets P stacked and the sheet feeding roller 405. By separating the sheet feeding roller 405 and the paper sheet from each other by a predetermined distance, the time until a sheet is brought into pressure contact with the sheet feeding roller 405 from the start of sheet feeding becomes uniform, and it is consequently possible to keep the sheet feeding operating time constant. Additionally, by separating a paper sheet at a position near the sheet feeding roller 405 and making the paper stand by, there are advantages that it is possible to prevent the middle plate 402 from ascending vigorously, and it is possible to reduce the collision sound between the paper sheet and the sheet feeding roller 405 generated during paper feeding.

Figure 10:
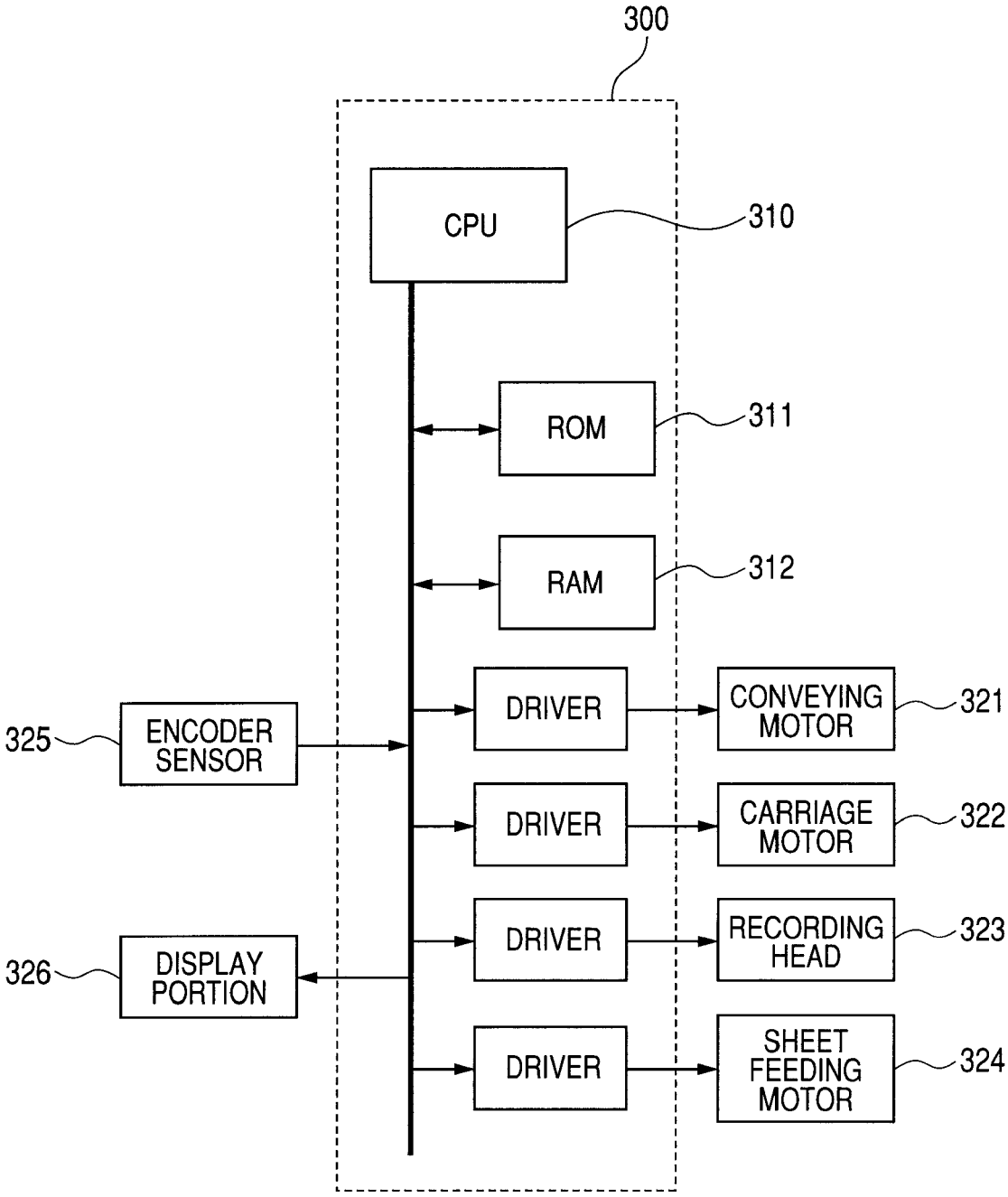
FIG. 10 is a control block diagram of the present embodiment.

FIG. 10 is a control block diagram of the present embodiment. In FIG. 10, a control unit 300 which is control unit includes a CPU 310, a ROM 311 which stores a program or fixed data, and a RAM 312 provided with a region where image data is developed, a working region, and the like.

A conveying motor 321 drives the conveying roller and the sheet ejection roller 24, a carriage motor 322 moves the carriage 22 for scanning, and a recording head is designated by reference numeral 323. Additionally, the control unit 300 also includes a driver for driving the various above-described motors and recording head 1. A sheet feeding motor which drives the sheet feeding roller 405 is designated by 324. The sheet feeding motor 324 also drives the depressing cam 407 and the control cam 412.

As for the sheet feeding motor 324, a DC motor is used as a motor for the driving of the sheet feeding apparatus. Also, a PWM (pulse width modulation) control is used as a driving control method of the DC motor. Additionally, a system is adapted so that a driving system is provided with an encoder 325 and the driving amount and driving speed of a driving system at a point of time of the output of the encoder 325 is capable of being calculated from the output of the encoder 325. The driving of the driving system of the sheet feeding apparatus related to the present embodiment is controlled by the feedback control of modulating (changing duty) the pulse width of an electric current to be applied to the DC motor on the basis of driving information, including driving amount, driving speed, and the like, and making the above driving amount and driving speed reach a targeted driving amount and driving speed. Here, if the pulse width is made large (the duty is made large), the motor output becomes large, and if pulse width is made small (the duty is made small), the motor output becomes small. That is, a control is made so that the duty of PWM is raised in order to raise the motor output in a case where the load applied to the driving system during motor driving has been increased, and the duty of PWM is lowered in order to suppress the motor output in a case where the load has been reduced.

Figure 9:
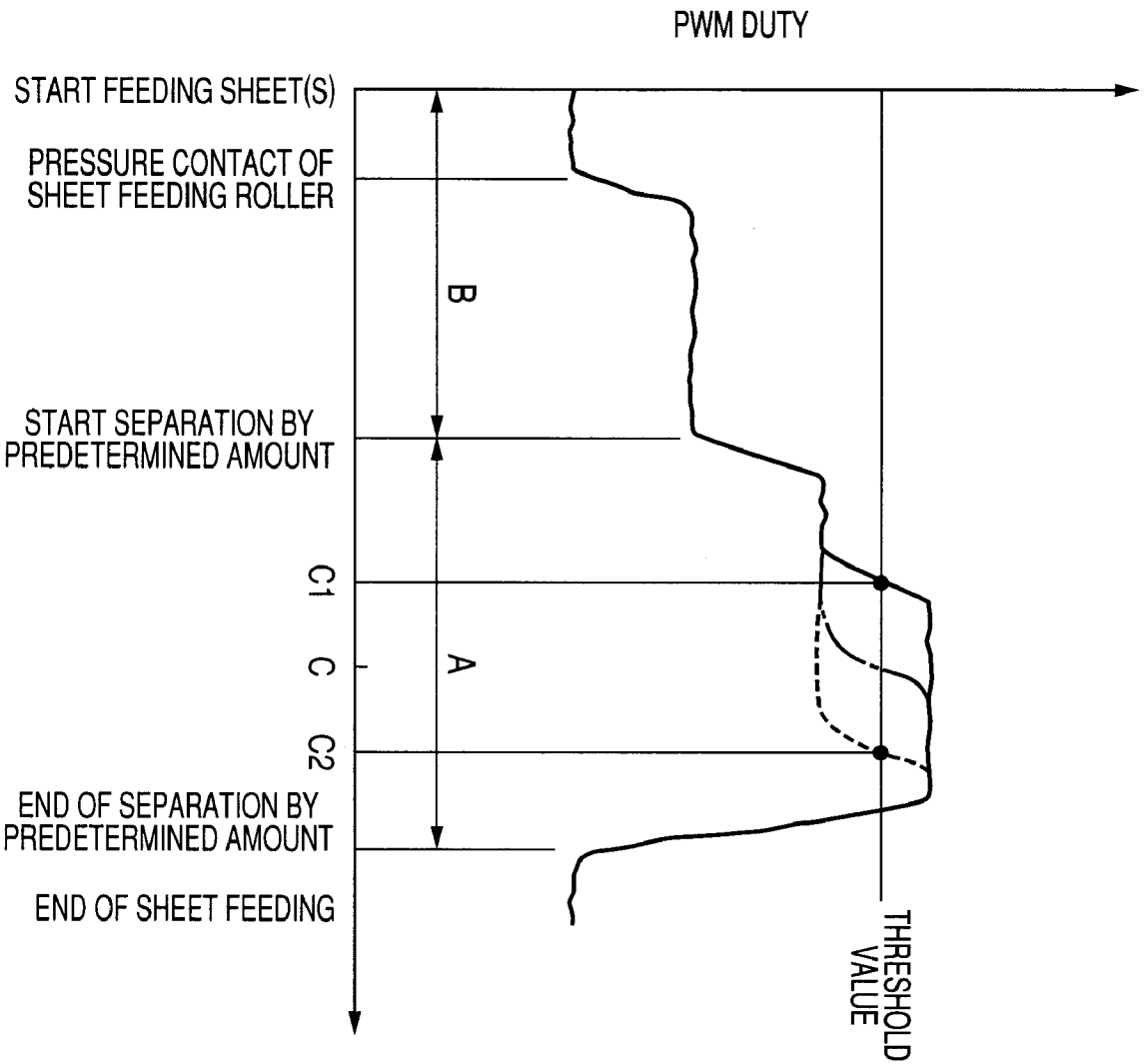
FIG. 9 is a graph of the PWM duty during the sheet feeding operation in the sheet feeding apparatus according to the present embodiment.

FIG. 9 is a graph illustrating changes in PWM duty during individual sheet feeding operations when the paper stacked amount of the sheet feeding cassette 400 is full, medium, and small. The horizontal axis represents the time from the start of the feeding of one paper sheet to the end of the feeding thereof. Additionally, the vertical axis represents PWM duty. A solid line indicates the PWM duty when paper sheets are fully stacked, a one-dot chain line indicates the PWM duty when paper sheets are stacked to a medium level, and a dotted line indicates the PWM duty when paper sheets are stacked to a low level. When sheet feeding is started, the PWM duty increases and decreases according to the magnitude of the loads applied to the driving system in the series of sheet feeding operations described above, such as the retreat operation of the return lever 410, the disengagement between the depressing claw 414 and the middle plate claw 416, the pressure contact between the sheet feeding roller 405 and the paper sheets, and the single sheet paper separating operation.

In the predetermined distance separation operation when the paper stacked amount within the cassette 400 is full, as illustrated in FIGS. 6D and 6A, the sliding portion 416D and the brake plate 420 maintain a contact state when the sliding portion 416D of the middle plate claw 416 moves downward during sheet feeding operation. In the predetermined distance separation operation when the paper stacked amount within the cassette 400 is medium, as illustrated in FIGS. 7D and 7A, the sliding portion 416D of the middle plate claw 416 comes into contact with the brake plate 420 similarly to when paper sheets are fully stacked. However, as illustrated in FIG. 7C, the sliding portion 416D has not yet descended to the same height as the brake plate 420 when the middle plate claw 416 and the depressing claw 414 begin to engage with each other. Therefore, the time at which the sliding portion 416D and the brake plate 420 begin to come into contact with each other will be later than when paper sheets are fully stacked.

Moreover, in a case where the paper stacked amount within the cassette 400 is small, as illustrated in FIGS. 8D and 8A, the sliding portion 416D and the brake plate 420 begin to come into contact with each other even later than when paper sheets are stacked to a medium level.

For this reason, in the predetermined distance separation operation in the sheet feeding operation, when paper sheets are fully stacked, the load torque caused by the brake plate 420 is added to the load torque of the driving system, the load torque increases at the beginning of the predetermined distance separation operation, and after this, the increased state is maintained until the time of sheet feeding standby. Additionally, the timing with which the load torque increases is gradually delayed as the paper stacked amount decreases. That is, when the uppermost face of the stacked paper sheets P is a predetermined separation distance from the sheet feeding roller 405, the brake plate 420 or the like becomes a load imparting unit which imparts load, and changes the load according to the turning angle of the middle plate (pressure plate).

Concerning operations other than the predetermined separation distance, the pressure contact force between the sheet feeding roller 405 and the paper sheets, the pressure contact force between the separation roller 409 and the sheet feeding roller 405, the turning torque of the return lever 410 and the holder release lever 411, and the like are uniformly set irrespective of the amount of stacked paper sheets within the cassette 400. For this reason, the variation of the motor load torque of the sheet feeding operation has different load torque variation curves during the predetermined distance separation operation, and has the same variation curve irrespective of a stacked amount when not in the predetermined distance separation operation. That is, the variation curve of the PWM duty of a motor during the sheet feeding operation has different variations during the predetermined distance separation operation (the range of A in FIG. 9), and has the same variation irrespective of a stacked amount when not in the predetermined distance separation operation (the range of A in FIG. 9). If the difference of this PWM duty variation curve is detected by a measuring unit, it is possible to detect an approximate paper stacked amount within the cassette 400.

Figure 11:
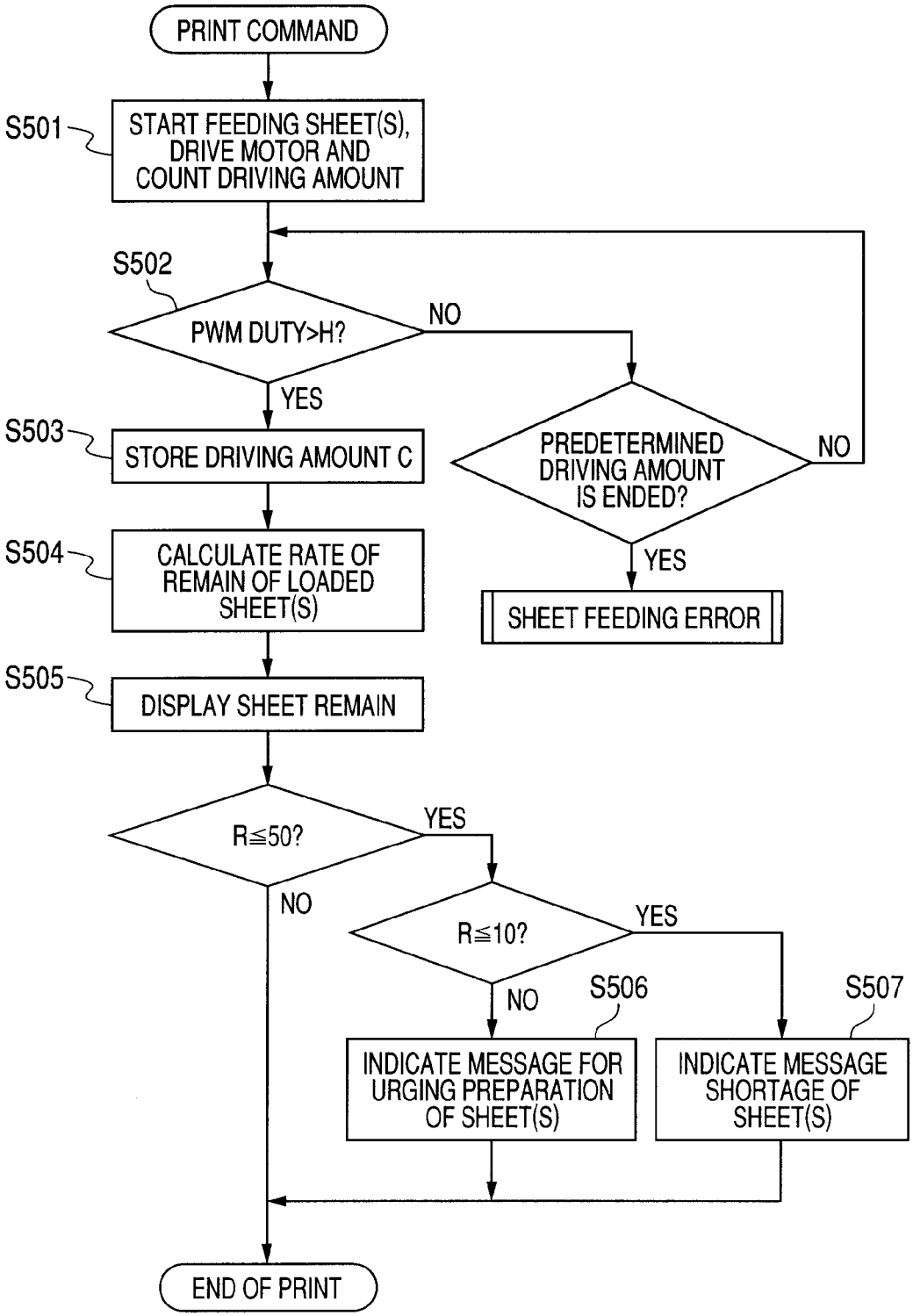
FIG. 11 is a flow chart for detection of the stacked amount of the sheet feeding apparatus according to the present embodiment.

FIG. 11 is a control flow chart of detection of the paper stacked amount within the cassette 400 and an apparatus display portion. H is a threshold value for determining whether or not the PWM duty meets the above-described increase curve. C is the motor driving amount from the start of sheet feeding when the PWM duty exceeds a threshold value H (a first driving amount). The motor driving amount (second driving amount) when the PWM duty exceeds the threshold value H when paper sheets are fully stacked is defined as C1, and the driving amount (third driving amount) when the PWM duty of the last paper sheet exceeds the threshold value H (when the last paper sheet is stacked) is defined as C2. In the following calculation formula, it is possible to roughly calculate the stacked paper residual amount ratio R within the cassette.

$$\text{Stacked paper residual amount ratio } R(\%)=(C2-C)/(C2-C1)\times 100.$$

Hereinafter, the details of the flow chart will be described with reference to FIG. 11. If a printing command is issued, driving of the sheet feeding motor is started, and simultaneously, counting of the driving amount of the motor is started (Step S501). Next, the value of the PWM duty of the sheet feeding motor is compared with the threshold value H (Step S502), and the driving amount C at that time is stored when the value of PWM exceeds H (Step S503). The stacked paper residual amount ratio R within the cassette is calculated according to the above-described calculation formula (Step S504). The stacked paper residual amount ratio R is displayed on the display portion (Step S505). Moreover, if $10<R\leqq 50$, a message which urges preparation of paper sheets is displayed on the display portion (Step S506), and if R10, a message which provides notification that paper sheets will soon run out is displayed (Step S507).

By such a display operation, an operator is able to know the rough residual amount of paper sheets in advance and prepare for supply of paper sheets, and it is possible to avoid trouble problem in which paper sheets run out suddenly, printing cannot be performed, and stalling occurs.

In the present embodiment, although two-step state transition of 50% and 10% as residual amounts is used, it is also possible to perform guide display according to a residual amount in detail for an operator through further finer divisions.

Additionally, it is also possible to provide an indicator portion using scales or the like on the display portion 326, and indicate a change in the above residual amount ratio R so as to know the change visually.

Accordingly, according to the invention, it is possible to detect the paper residual amount within the cassette without adding a new sensor for detecting paper stacked amount, and it is also possible to construct the invention easily without necessitating complicated mechanisms. For this reason, costs can also be suppressed.

In the above embodiment, the stacked paper residual amount ratio R is calculated using the driving amount C. However, the information of the residual amount may be issued simply according to the driving amount C, and may be displayed on the display portion 236. For example, when the driving amount C is within a first range between C1 and C2 of FIG. 9, the paper residual amount is displayed to be a first residual amount (for example, 50% of residual amount), and when the driving amount is within a second range greater than C2, the paper residual amount is displayed to be a second residual amount (10% of residual amount).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-282696, filed Dec. 14, 2009 which is hereby incorporated by reference herein in its entirety.

What is claimed is:

1. A sheet feeding apparatus comprising:

a feeding unit which abuts on a sheet and feeds the sheet;

a pressure plate having sheets stacked thereon, and turnably supported so that a sheet on the uppermost layer among the stacked sheets abuts on the feeding unit;

a biasing unit which biases the pressure plate in order to bring the sheets stacked on the pressure plate into pressure contact with the feeding unit;

a separating unit which depresses the pressure plate against the biasing force of the biasing unit and separates the sheet from the feeding unit by a predetermined distance;

a separation driving unit which drives the separating unit;

a measuring unit which measures the driving load applied to the separation driving unit when the separation driving unit drives the separating unit; and a load imparting unit which imparts load to at least any one of the pressure plate, the separating unit, and the separation driving unit, wherein the load imparting unit imparts load when the sheet is separated from the feeding unit by the separating unit, and the load imparting unit changes the load to be imparted, according to the turning angle of the pressure plate, and wherein the separation driving unit includes a DC motor, and the measuring unit calculates the driving load applied to the separation driving unit from a PWM duty at the time of the driving of the DC motor.

2. The sheet feeding apparatus according to claim 1, wherein a first driving amount of the separation driving unit until the load measured by the measuring unit exceeds a predetermined threshold value is calculated, a second driving amount of the separation driving unit until the load according to the turning angle of the pressure plate when the paper sheets are fully stacked exceeds the threshold value is calculated, a third driving amount of the separation driving unit until the load according to the turning angle of the pressure plate when one sheet is stacked exceeds the threshold value is calculated, and the amount of the sheets stacked on the pressure plate is calculated by comparing the first driving amount with the second driving amount and the third driving amount.

3. A sheet feeding apparatus comprising:

a feeding unit which abuts on a sheet and feeds the sheet;

a pressure plate having sheets stacked thereon;

a biasing unit which biases the pressure plate in order to bring the sheets stacked on the pressure plate into pressure contact with the feeding unit;

a separating unit which depresses the pressure plate against the biasing force of the biasing unit and separates the sheet from the feeding unit by a predetermined distance;

a separation driving unit which drives the separating unit; and a load imparting unit which imparts load to at least any one of the pressure plate, the separating unit, and the separation driving unit;

a measuring unit which measures the driving load applied to the separation driving unit when the separation driving unit drives the separating unit, wherein the load imparting unit imparts load when the sheet is separated from the feeding unit by the separating unit, and the load imparting unit imparts load when the distance between the pressure plate and the feeding unit is greater than a predetermined distance, and wherein information on the amount of the sheets stacked on the pressure plate is issued according to the driving amount of the separation driving unit until the load imparted by the load imparting unit exceeds a predetermined threshold value after the separation driving unit starts driving.

4. The sheet feeding apparatus according to claim 3, wherein the information on the amount of the sheets stacked on the pressure plate is issued according to the driving amount of the separation driving unit until the load imparted by the load imparting unit exceeds a predetermined threshold value after the separation driving unit starts driving.

5. The sheet feeding apparatus according to claim 3, wherein information on a first residual amount is issued when the driving amount of the separation driving unit until the load imparted by the load imparting unit exceeds a predetermined threshold value after the separation driving unit starts driving, and information on a second residual amount is issued when the driving amount is within a second range.

6. The sheet feeding apparatus according to claim 5, further comprising a display portion which displays information on the residual amount of the sheets.

7. An image forming apparatus comprising the sheet feeding apparatus according to claim 3 and image forming unit which forms an image on a sheet fed by the sheet feeding apparatus.

* * * * *